United States Patent [19]

Iwamoto et al.

[11] Patent Number: 4,665,867

[45] Date of Patent: May 19, 1987

[54] COOLING STRUCTURE FOR MULTI-CYLINDER PISTON-ENGINE CYLINDER BLOCK

[75] Inventors: Hiroshi Iwamoto; Yoshio Taguchi, both of Yokohama, Japan

[73] Assignee: Nissan Motor Company, Limited, Yokohama, Japan

[21] Appl. No.: 709,654

[22] Filed: Mar. 8, 1985

[30] Foreign Application Priority Data

Mar. 12, 1984 [JP] Japan ..... 59-45602

[51] Int. Cl.[4] ..... F01P 3/02

[52] U.S. Cl. ..... 123/41.28; 123/41.74

[58] Field of Search ..... 123/41.28, 41.72, 41.74, 123/41.79, 193 C

[56] References Cited

U.S. PATENT DOCUMENTS

| | | | |
|---|---|---|---|
| 1,680,567 | 8/1928 | Pitzman | 123/41.28 |
| 2,089,454 | 8/1937 | Walden | 123/41.28 |
| 2,368,080 | 1/1945 | Ginn et al. | 123/41.28 |
| 2,953,126 | 9/1960 | Kolbe | 123/41.28 |
| 4,419,970 | 12/1983 | Shaw | 123/41.74 |
| 4,493,294 | 1/1985 | Umemura | 123/41.74 |

FOREIGN PATENT DOCUMENTS

| | | |
|---|---|---|
| 631994 | 9/1948 | United Kingdom . |
| 1280950 | 7/1972 | United Kingdom . |
| 2143583 | 2/1985 | United Kingdom . |

*Primary Examiner*—William A. Cuchlinski, Jr.

*Attorney, Agent, or Firm*—Schwartz, Jeffery, Schwaab, Mack, Blumenthal & Evans

[57] ABSTRACT

A cooling structure for a multi-cylinder piston-engine cylinder block includes a side coolant gallery distributing coolant into a water jacket surrounding a group of cylinders arranged from upstream to downstream. The flow cross-section of the coolant gallery decreases toward its downstream end. The water jacket has a water jacket wall which constitutes part of the coolant gallery. The water jacket wall includes a group of coolant inlets, each of which directs coolant towards the upper part of each of the cylinders. At least one coolant inlet is offset from the center of the corresponding cylinder toward a clearance between adjoining cylinders. This cooling structure can cool all of the cylinders uniformly and the entire surface of each cylinder evenly.

18 Claims, 6 Drawing Figures

COOLING STRUCTURE FOR MULTI-CYLINDER PISTON-ENGINE CYLINDER BLOCK

BACKGROUND OF THE INVENTION

1. Field of the Invention

This invention relates to a cooling structure for a multi-cylinder piston-engine cylinder block and more particularly to a coolant passage arrangement in the cooling structure.

2. Description of the Prior Art

A coolant passage arrangement in a cooling structure of a multi-cylinder piston-engine cylinder block must cool the upper sections of the engine cylinders constituting combustion chambers and walls joining two cylinders as effectively as the rest of the cylinder surface area despite the lower thermal emissivity of the former and must also uniformly cool all of the cylinders of said cylinder block.

FIGS. 1 and 2 show an example of a prior art coolant passage arrangement in a cylinder block (See page 80 of the September 1970 extra issue of *Internal Combustion Engine,* published by Kabushiki Kaisha Sankaidoh of Japan).

Individual cylinders in a row of cylinders 1 to 6 are separated by relatively small clearances P inside a cylinder block 7 and surrounded by a water jacket 8 defined by a continuous water jacket casing with four vertical sides 9, 10, 11 and 12. The clearance P is as small as possible in order to minimize the length of the cylinder block 7. The cylinder 2 is rigidly connected to the cylinders 1 and 3 by intervening ribs 13 and the cylinder 5 is similarly connected to the cylinders 4 and 6 by intervening ribs 13. Each of the ribs 13 includes an opening connecting the longitudinal sides of the water jacket 8 opposite the walls 9 and 10. The water jacket walls 9, 10 and 11 have bosses 18, each of which includes a smooth hole 19. Bolts pass through the holes 19 in order to clamp a cylinder head (not shown) onto the cylinder block 7.

The water jacket wall 10 has six coolant inlets 15, each of which faces directly toward the vertical axis of the corresponding cylinder 1 to 6, and has a side coolant gallery 14 extending along and to one side of the cylinders 1 to 6. The clearance $C_1$ between cylinder 1 and upstream-side water jacket wall 11 as well as upstream ends of the water jacket walls 9 and 10 and the clearance $C_2$ between cylinder 6 and downstream-side water jacket wall 12 as well as the downstream ends of the water jacket walls 9 and 10 are significantly larger than the clearance P.

The side coolant gallery 14 has an essentially constant cross-section throughout its length and is connected to the water jacket 8 through the coolant inlets 15. The upstream end 16 of the side coolant gallery 14 is connected to an outlet from a water pump (not shown) whereas, the downstream end 17 of the side coolant gallery 14 is closed.

With this coolant passage arrangement, the coolant leading from the water pump to the side coolant gallery 14 enters the front half of the water jacket 12 through the respective coolant inlets 15. A stream of coolant passing through each coolant inlet 15 strikes the center of the forward surface of each of the cylinders 1 to 6, i.e. the surfaces facing wall 10, and follows the forward surface to the right and left. Streams of coolant branching around the forward surfaces of the cylinders 2 to 5 pass through the openings in the ribs 13 and the clearance between the cylinders 3 and 4 to the rear half of the water jacket 8 thus cooling the opposing walls of the adjacent cylinders 2 to 5. On the other hand, streams of coolant branching around the forward surfaces of the cylinders 1 and 6 pass through the clearances between the upstream-side water jacket wall 11 and the cylinder 1, and the downstream-side water jacket wall 12 and the cylinder 6 to the rear half of the water jacket 8, thus cooling the upstream-side outer surface of the cylinder 1 and the downstream-side outer surface of the cylinder 6. Then, the coolant having cooled the cylinders 1 to 6 flows out of the cylinder block 7 to coolant passages in a cylinder head (not shown).

This prior art cooling structure entails several drawbacks. First, since the coolant passing through the side coolant gallery 14, which has an essentially constant cross-section throughout its length, enters the front half of the water jacket 8 through the coolant inlets 15 in an upstream-to-downstream order, the coolant flow around the upstream-side cylinders is greater than that around the downstream-side cylinders, which may lead to overheating of the downstream-side cylinders and concomitant abrasion of the pistons in the downstream-side cylinders. Second, the forward surfaces of the cylinders 1 to 6 exert a great resistance to coolant flow from the coolant inlets 15, thus greatly reducing the coolant flow through the openings in the rib 13, which may lead to inadequate cooling of the opposing walls of adjoining cylinders. Third, since the resistance in the clearances $C_1$ and $C_2$ around the cylinders 1 and 6 is smaller than in the openings through the ribs 13 and in the clearance between the cylinders 3 and 4 even though the cylinders 1 and 6, in particular the upstream-side of the cylinder 1 and the downstream-side of the cylinder 6, are more emissive than the remaining cylinders 2 to 5, the coolant flow through the clearances $C_1$ and $C_2$ is greater than through the openings in the ribs 13 and the clearance between the cylinders 3 and 4, which again means less cooling of the opposing walls of adjoining cylinders.

SUMMARY OF THE INVENTION

An object of this invention is to provide a cooling structure for a multi-cylinder piston-engine cylinder block which can uniformly cool a group of cylinders. In order to accomplish this object, the cooling structure includes a side coolant gallery distributing coolant into a water jacket surrounding a plurality of cylinders arranged upstream-to-downstream, the flow cross-section of the coolant gallery decreasing toward the downstream end. The water jacket has a water jacket wall which constitutes part of the coolant gallery. The water jacekt wall includes a group of coolant inlets, each of which directs coolant onto an upper section of a corresponding cylinder. The decrease in the flow cross-section of the side coolant gallery toward the downstream end ensures a uniform flow through each of the coolant inlets. The cooling structure also includes means for increasing coolant flow through the clearances between the cylinders relative to coolant flow through the clearances between the cylinders and the water jacket so as to induce an approximately equal rate of flow through the two types of clearances. In addition, for the purpose of the cooling of opposing walls between adjoining cylinders, the axis of at least one coolant inlet may be offset from the center of the corresponding cylinder.

According to this invention, heat will be distributed evenly over the surface of each cylinder so that thermal stresses in walls of the cylinder will be minimized. This also means less abrasion and greater durability of the inner surfaces of each cylinder and that the gas-leakage through an internal combustion chamber can be prevented. Furthermore, the heat flow is more evenly matched among the cylinders.

DESCRIPTION OF THE PREFERRED EMBODIMENTS

Figure 1:
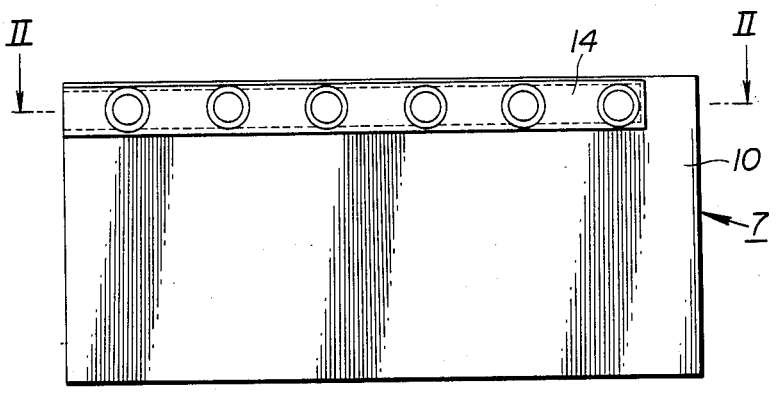
FIG.1 (PRIOR ART)
FIG. 1 is a side elevation of a prior art cooling structure for multi-cylinder piston-engine cylinder block.
Figure 2:
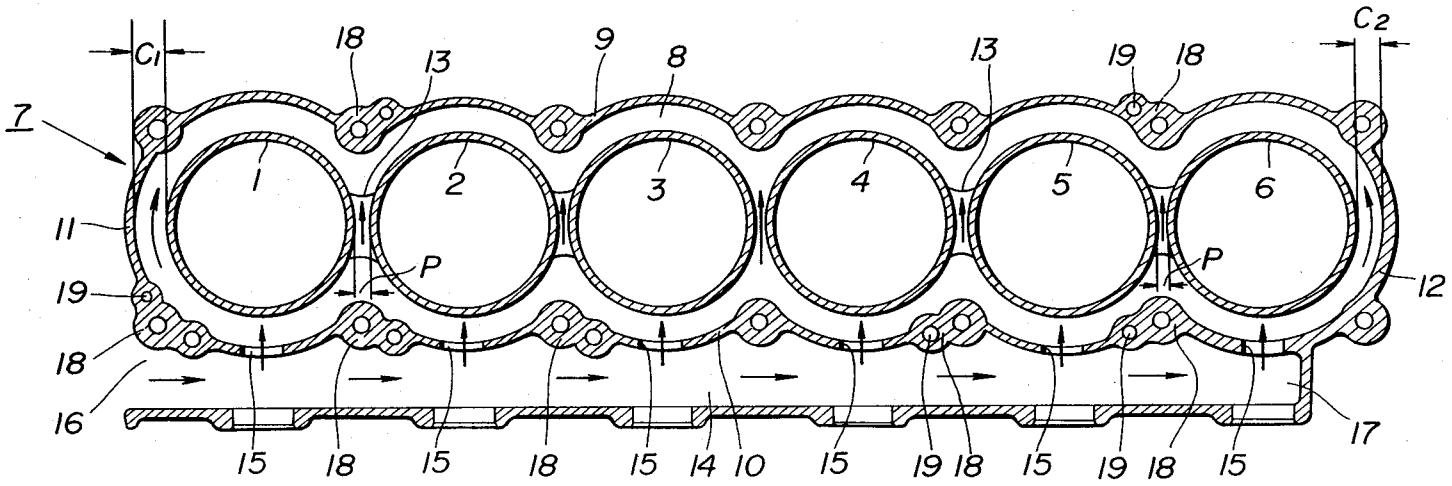
FIG. 2 (PRIOR ART)
FIG. 2 is a plan view of a horizontal cross-section, taken along the line II—II, of the cooling structure of FIG. 1.

The preferred embodiment of this invention will be described in detail with reference to FIGS. 3 to 6. Elements of this invention similar to those of the prior art cooling structure of FIGS. 1 and 2 are labelled with the same reference numerals.

A water jacket 20 surrounding a row of cylinders 1 to 6 is defined by four contiguous water jacket walls 9, 11, 12 and 21. The water jacket wall 21 which is opposite the engine axis from the water jacket wall 9 has a side coolant gallery 30, six coolant inlets 22 to 27 and first and second flow-resistive ribs 28 and 29.

Figure 3:
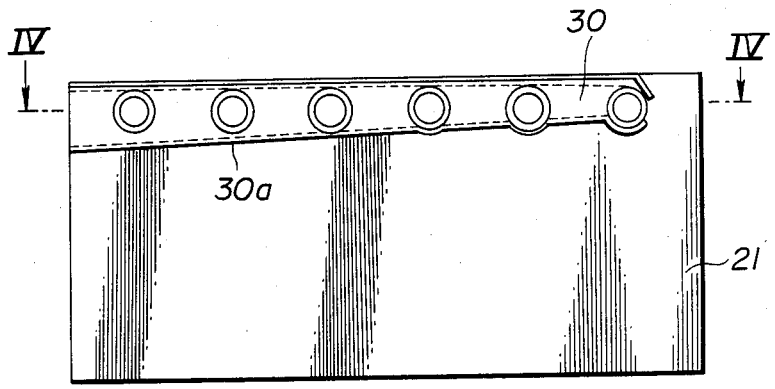
FIG. 3 is a side elevation of a cooling structure for a multi-cylinder piston-engine cylinder block according to this invention.

The side coolant gallery 30 is formed along the upper edge of the water jacket wall 21 and extends parallel to the row of the cylinders 1 to 6. As shown in FIG. 3, the floor 30*a* of the side coolant gallery 30 rises from its upstream end to its downstream end so that the flow cross-section of the side coolant gallery 30 decreases from upstream to downstream to ensure an essentially even flow distribution among the coolant inlets 22 to 27.

Figure 4:
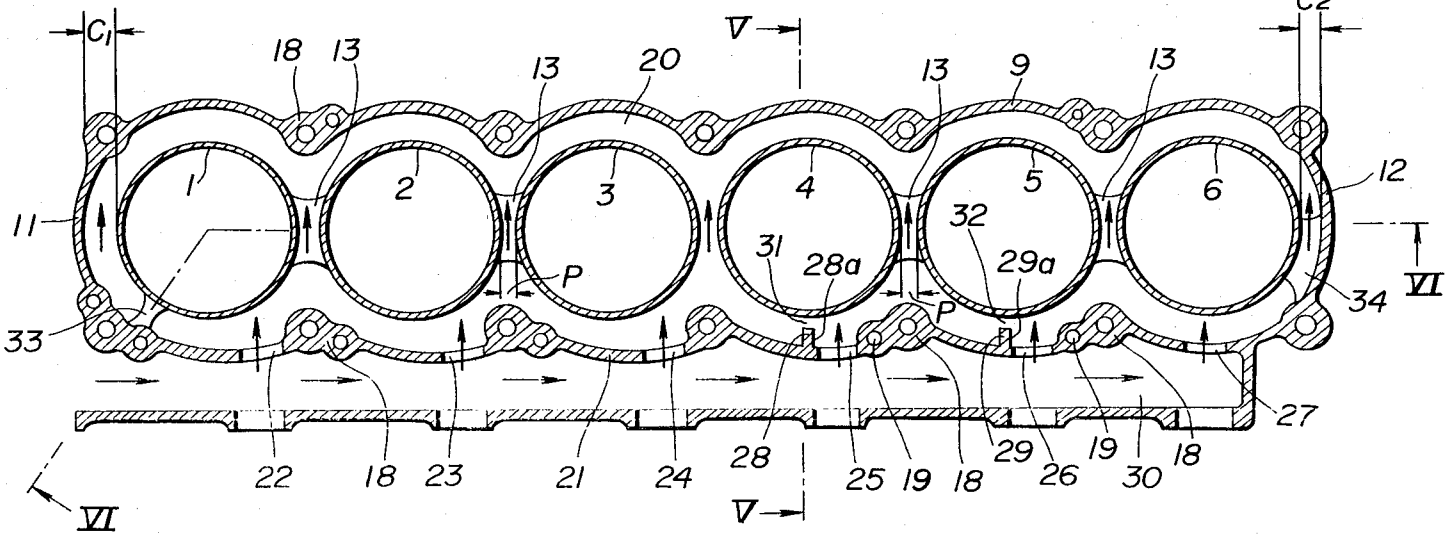
FIG. 4 is a plan view of a horizontal cross-section, taken along the line IV—IV, of the cooling structure of FIG. 3.
Figure 5:
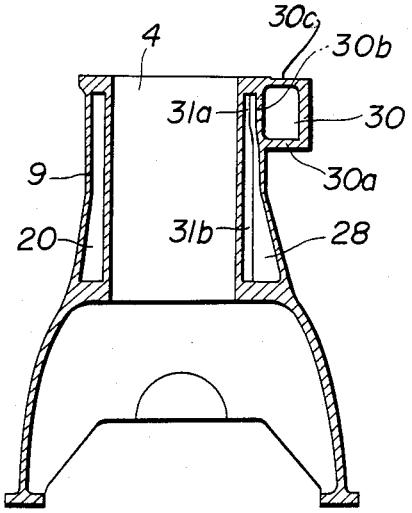
FIG. 5 is a vertical cross-section of the cooling structure of FIG. 3, taken along the line V—V in FIG. 4.
Figure 6:
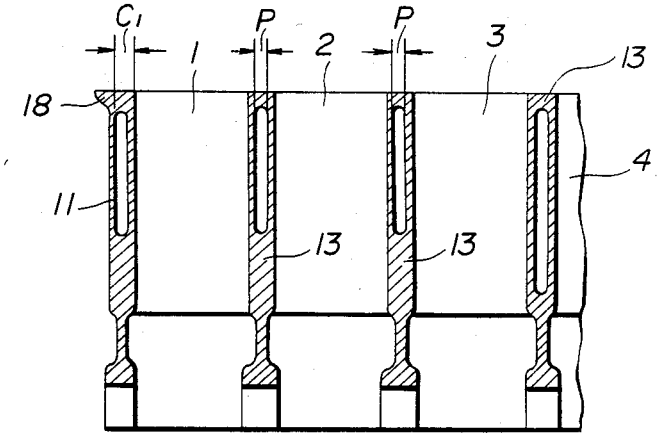
FIG. 6 is a vertical longitudinal section of the cooling structure of FIG. 3, taken along the line VI—VI in FIG. 4.

The coolant inlets 22 to 27 are all disposed in a common wall section 30*b*, visible in FIG. 5, separating the water jacket 20 from the side coolant gallery 30. The gallery 30 includes a closed top wall 30*c*. The coolant inlets 22 to 26, as shown in FIG. 4, are offset toward downstream ends of the corresponding cylinders 1 to 5. The coolant inlets 22 to 24 opposing the upstream group of cylinders 1 to 3 are all offset to the same extent. On the other hand, the coolant inlets 25 and 26 corresponding to the cylinders 4 and 5 of the downstream group of cylinders are equally offset to a lesser extent than the coolant inlets 22 to 24 because the bosses 18 opposite the cylinders 4 and 5 limit the offset of the coolant inlets 25 and 26.

As shown in FIGS. 4 and 5, first and second flow-resistive ribs 28 and 29 project toward the center of the cylinders 4 and 5 from the inner surface of the water jacket wall 21 and extend from the ceiling to the floor of the water jacket 20 near the upstream edges of the coolant inlets 25 and 26. The coolant-inlet-side surfaces 28*a* and 29*a* of the first and second flow-resistive ribs 28 and 29 lie in the front-to-rear diametric planes of the cylinders 4 and 5. The first and second flow-resistive ribs 28 and 29 form flow-restriction orifices 31 and 32 in conjunction with the outer surfaces of the cylinders 4 and 5. As shown in FIG. 5, the orifice 31 consists of a relatively narrow upper section 31*a* and a relatively wide lower section 31*b*. The orifice 32 has the same shape as the orifice 31. The orifices 31 and 32 serve to distribute the flow through the coolant inlets 25 and 26 evenly toward the right or the left, so that the flow through the openings in the ribs 13 between the cylinders 4 and 5 and between the cylinders 5 and 6 can match the flow through the openings in the ribs 13 between the cylinders 1 and 2 and between the cylinders 2 and 3 as well as the flow through the clearance between the cylinders 3 and 4. The offsets of the coolant inlets 22 to 26 serve to increase the flow through the clearances between the opposing walls of adjoining cylinders to match the flow through the clearances between the cylinder walls and water jacket walls 9, 11, 12 and 21. The coolant inlet 27 is not offset from the center of the cylinder 6.

As shown in FIGS. 4 and 5, a third flow-resistive rib 33 connects the wall of the cylinder 1 to the far-upstream boss 18 and a fourth flow-resistive rib 34 connects the wall of the cylinder 6 to the downstream water jacket wall 12. The third and fourth flow-resistive ribs 33 and 34 include the same openings or orifices as in the ribs 13. The third flow-resistive rib 33 is narrower than the fourth flow-resistive rib 34 because the coolant inlet 22 is offset downstream whereas the coolant inlet 27 is not offset, as previously described. The flow through the openings in the flow-resistive ribs 33 and 34 is weaker than in the clearances between the opposing walls of adjoining cylinders because the upstream side of the cylinder 1 and the downstream side of the cylinder 6 are not subject to the thermal influence of the other cylinders 2 to 5.

This invention is applicable with minor modifications to cylinder blocks of the other types of multi-cylinder piston engines.

What is claimed is:

1. A cooling structure for a multi-cylinder piston-engine cylinder block, comprising:

a plurality of cylinders arranged linearly with a given clearance between each pair of adjoining cylinders through which clearance coolant can flow;

a side coolant gallery having a closed top wall and being parallel to the line of cylinders for distributing a fluid coolant among the cylinders, the flow cross-section area of said side coolant gallery decreasing from its upstream end to its downstream end; and a water jacket surrounding the cylinders and having a water jacket wall constituting part of said side coolant gallery, the water jacket wall including a plurality of coolant inlets, each of which directs coolant onto an upper part of a corresponding cylinder.

2. A cooling structure as recited in claim 1, wherein said side coolant gallery extends along the upper parts of said cylinders.

3. A cooling structure as recited in claim 2, wherein a floor of said side coolant gallery approaches a ceiling thereof from the upstream end toward the downstream end thereof.

4. A cooling structure as recited in claim 1, further comprising:

flow-resistive means reducing the clearance between the water jacket and the upstream side of the far-upstream cylinder.

5. A cooling structure as recited in claim 1, further comprising:

flow-resistive means reducing the clearance between the water jacket and the downstream side of the far-downstream cylinder.

6. A cooling structure for a multi-cylinder in-line piston-engine cylinder block, comprising:

a plurality of cylinders arranged linearly with a given clearance through which coolant can flow between each pair of adjoining cylinders;

a water jacket surrounding said cylinders at a given clearance;

means driving a fluid coolant through said water jacket generally in the direction from a far-upstream cylinder toward a far-downstream cylinder; and means partially restricting coolant flow through the clearance between said water jacket and said cylinders relative to flow through the clearances between adjoining cylinders so as to approximately evenly cool the cylinders.

7. A cooling structure for a multi-cylinder piston-engine cylinder block, comprising:

a plurality of cylinders arranged linearly with a given clearance between each pair of adjoining cylinders through which a coolant can flow;

a side coolant gallery parallel to the line of cylinders for distributing said coolant among the cylinders, the flow cross-section area of said side coolant gallery decreasing from its upstream end to its downstream end;

a water jacket surrounding the cylinders and having a water jacket wall constituting part of said side coolant gallery, the water jacket wall including a plurality of coolant inlets, each of which directs coolant onto an upper part of a corresponding cylinder; and means for increasing coolant flow through the clearances between adjoining cylinders relative to coolant flow through the clearances between the cylinders and the water jacket.

8. A cooling structure as recited in claim 7, wherein said flow-increasing means comprises at least one of said coolant inlets, the axis of which is offset from the center of the corresponding cylinder toward the clearance between the corresponding cylinder and an adjoining cylinder.

9. A cooling structure as recited in claim 8, wherein said offset coolant inlet corresponds to the far-upstream cylinder.

10. A cooling structure as recited in claim 8, wherein the coolant inlet corresponding to the far-downstream cylinder is not offset from the center of said cylinder.

11. A cooling structure as recited in claim 7, wherein said flow-increasing means comprises all of the coolant inlets other than the coolant inlet corresponding to the far-downstream cylinder, the axis of each of the flow-increasing coolant inlets being offset toward the downstream end of said side gallery from the center of each corresponding cylinder.

12. A cooling structure as recited in claim 11, further comprising:

second flow-resistive means reducing the clearance between the water jacket and the upstream side of the far-upstream cylinder and including a first opening through which coolant can flow; and third flow-resistive means reducing the clearance between the water jacket and downstream-side of the far-downstream cylinder and including a second opening through which coolant can flow; and wherein the first opening is shorter than the second opening.

13. A cooling structure as recited in claim 7, wherein said flow-increasing means comprises first flow-resistive means reducing the clearance between at least one cylinder and the water jacket to one side of at least one of said coolant inlets.

14. A cooling structure as recited in claim 13, wherein the first flow-resistive means comprises a rib disposed immediately upstream of one coolant inlet.

15. A cooling structure as recited in claim 14, wherein the rib extends from a ceiling to a floor of the water jacket and forms a flow-restriction orifice in cooperation with a cylinder opposing the rib.

16. A cooling structure as recited in claim 15, wherein an upper part of the orifice opposing the upper part of the cylinder is narrower than a lower part of the orifice opposing the lower part of the cylinder.

17. A cooling structure as recited in claim 15, wherein the inner surface of the water jacket wall has a boss narrowing the clearance between the water jacket and a cylinder downstream of the corresponding coolant inlet.

18. A cooling structure for a multi-cylinder piston-engine cylinder block, comprising:

a plurality of cylinders arranged linearly with a given clearance between each pair of adjoining cylinders through which clearance coolant can flow;

a side coolant gallery parallel to the line of cylinders for distributing a fluid coolant among the cylinders, the flow cross-section area of said side coolant gallery decreasing from its upstream end to its downstream end; and a water jacket surrounding the cylinders and having a water jacket wall constituting part of said side coolant gallery, the water jacket wall including a plurality of coolant inlets, each of which directs coolants onto an upper part of a corresponding cylinder;

wherein the axes of all of the coolant inlets other than the coolant inlets corresponding to the far-downstream cylinder are offset toward the downstream end of said side gallery from the center of each corresponding cylinder.

* * * * *